US006742302B2

(12) United States Patent
Kärkkäinen

(10) Patent No.: US 6,742,302 B2
(45) Date of Patent: Jun. 1, 2004

(54) CLOSURE SEQUENCE CONTROL ARRANGEMENT FOR DOUBLE DOORS

(75) Inventor: Vesa Kärkkäinen, Joensuu (FI)

(73) Assignee: Abloy Oy, Joensuu (FI)

( * ) Notice: Subject to any disclaimer, the term of this patent is extended or adjusted under 35 U.S.C. 154(b) by 84 days.

(21) Appl. No.: 10/141,562

(22) Filed: May 7, 2002

(65) Prior Publication Data

US 2002/0166287 A1 Nov. 14, 2002

(30) Foreign Application Priority Data

May 8, 2001 (FI) ..... 20010955

(51) Int. Cl.[7] ..... E05F 5/12
(52) U.S. Cl. ..... 49/103; 49/366
(58) Field of Search ..... 49/103, 104, 107, 49/108, 109, 110, 366, 367; 16/63, 65, 85

(56) References Cited

U.S. PATENT DOCUMENTS

| | | | | | |
|---|---|---|---|---|---|
| 1,875,631 | A | * | 9/1932 | Mariotti | 49/101 |
| 1,908,211 | A | * | 5/1933 | Albach | 49/96 |
| 1,965,841 | A | * | 7/1934 | Kraft et al. | 49/26 |
| 2,398,602 | A | * | 4/1946 | Sibley et al. | 292/278 |
| 2,965,918 | A | * | 12/1960 | Leanza | 16/82 |
| 3,822,506 | A | * | 7/1974 | Fishbach | 49/367 |
| 4,190,926 | A | * | 3/1980 | Cronin | 16/65 |
| 4,656,690 | A | * | 4/1987 | Katagiri et al. | 16/48.5 |
| 4,949,505 | A | * | 8/1990 | Cohrs | 49/367 |
| 4,967,512 | A | * | 11/1990 | Schroder et al. | 49/367 |
| 5,446,944 | A | * | 9/1995 | Coleman et al. | 16/85 |
| 5,461,754 | A | * | 10/1995 | Tillmann et al. | 16/82 |
| 5,651,216 | A | * | 7/1997 | Tillmann | 49/367 |
| 5,727,286 | A | * | 3/1998 | Shen | 16/49 |
| 5,906,026 | A | * | 5/1999 | Junttila | 16/85 |
| 5,944,399 | A | * | 8/1999 | Gillispie | 312/324 |
| 6,253,417 | B1 | * | 7/2001 | Rusiana | 16/82 |
| 6,449,904 | B1 | * | 9/2002 | Paasonen | 49/103 |
| 6,564,510 | B2 | * | 5/2003 | Juntunen et al. | 49/103 |
| 2001/0025450 | A1 | * | 10/2001 | Juntunen et al. | 49/103 |

FOREIGN PATENT DOCUMENTS

| | | |
|---|---|---|
| DE | 195 45 401 | 6/1997 |
| EP | 0 458 034 | 11/1991 |
| EP | 0 790 381 | 8/1997 |

* cited by examiner

*Primary Examiner*—Gregory J. Strimbu
(74) *Attorney, Agent, or Firm*—Smith-Hill and Bedell

(57) ABSTRACT

A closure sequence controller for a pair of first and second door leaves pivotable with respect to a door frame includes an elongate guide rail for mounting to the door frame, a first elongate sliding bar positioned in the guide rail and functionally connected to the first door leaf in a manner such that the first sliding bar moves in response to pivotal movement of the first door leaf relative to the door frame, and a sequence control unit installed in the guide rail and functionally connected to the first sliding bar. The sequence control unit includes a lock body structure defining a chamber through which the first sliding bar extends and having a guiding surface that is inclined with respect to the first sliding bar. A blocking member is located in the chamber and movable therein longitudinally of the first sliding bar. A biasing element urges the blocking member in a direction towards a position in which the blocking member is clamped tightly against the first sliding bar and prevents closing of the first door leaf.

22 Claims, 6 Drawing Sheets

CLOSURE SEQUENCE CONTROL ARRANGEMENT FOR DOUBLE DOORS

BACKGROUND OF THE INVENTION

The invention relates to a closure sequence control arrangement for turnable double doors.

In order to lock double doors to each other one door leaf, a so called active door, is provided preferably with a latch bolt protruding from a lock case mounted in the active door. As a consequence the door leaves must be closed in a certain order so that the active door provided with the latch bolt is closed last. Thereby the spring loaded latch bolt can be pressed, due to its bevelled guiding surface, into the lock case in order to fully close the active door. In the closed position, the latch bolt can move again, urged by the spring, into its protruding position in which it engages the passive or auxiliary door and locks the door leaves to each other.

A closure sequence control arrangement is disclosed in the document EP 0 458 034. In this known arrangement a clamping plate is utilized which is turnable around a certain journal point and through an opening of which a sliding bar, dependent on the movements of the active door, extends. In case the auxiliary door is too far open, the clamping plate is able to turn, whereby the sliding bar is tightly clamped against the edges of the opening and thus its movement is prevented. Keeping the clamping plate in its neutral position, which allows movement of the sliding bar, requires on the one hand spring load and on the other hand a sliding bar connected to the movements of the auxiliary door. This sliding bar is utilized also to release the locking provided by the clamping plate. The arrangement is complicated both as to its construction and its operation.

A closure sequence control arrangement with considerably simpler construction is disclosed in the document EP 0 867 587. This arrangement makes use of a blocking piece moving transversely in a guide rail and which, on the basis of the position of a connection arm dependent on the movements of the auxiliary door, prevents or allows movement in the direction of the guide rail of the head of a turning arm attached to the active door. This arrangement cannot, however, be utilized for instance for selective hold-opening of the active door at different opening angles.

A further closure sequence control arrangement is disclosed in the document DE 195 45 401 A1, according to which the sequence control unit includes a wedge-like member which is arranged to press a sliding bar against the inner surface of a guide rail, which for this purpose is provided with a friction coating at the position of the sequence control unit. Additionally the operation of the wedge-like member makes use of bearing means to provide for movement thereof.

An aim of the invention is to provide a new and improved closure sequence control arrangement for double doors, from which the defects and drawbacks of the prior known arrangements are essentially eliminated. An aim of the invention is more clearly to provide a closure sequence control arrangement for double doors, which is simple as to its construction and is operationally reliable. A further aim is that the arrangement can easily be applied to provide hold-open function for the active door in different opening positions as selected.

SUMMARY OF THE INVENTION

In accordance with the invention the sequence control unit includes a lock body element, which has a chamber through which a first elongate sliding bar is led and within which a blocking member is located. The chamber is provided with a guiding surface, which is inclined with regard to the first sliding bar and acts on the blocking member for providing a clamping effect. Hereby the sliding bar is supported by the lock body element and the blocking member can be tightly pressed between the sliding bar and the guiding surface. The arrangement is simple since it does not require that the blocking member be turnably supported around any certain journal point. On the other hand since the blocking member is moved in the direction of the sliding bar, its blocking function is not dependent on the sliding bar being in any particular position and thus on the actual opening position of the active door, which enables hold-opening of the active door invariably in different hold-open positions according to need.

The guiding surface is with advantage a surface of a separate guiding member installed in the chamber. In this case it can with advantage be of some hard and wear resistant material, for instance hardened steel, independent of the material of the lock body element itself.

The chamber encloses with advantage a bias spring means arranged to urge the blocking member in the direction for providing the clamping effect. Hereby it can be ensured that the blocking member can grip the sliding bar for providing the clamping effect so that the sliding bar is locked and remains immovably in its position.

A so-called overload protection can with advantage be provided so that the lock body element is movably supported to a body member of the sequence control unit fixed to the guide rail. Then the movement of the lock body element in the direction for providing the clamping effect can be arranged to occur against the force of a spring. The spring may be supported to the body member and installed on an adjustment screw which extends through the wall of the body member and is in threaded engagement with the lock body element.

By locating the lock body element and the body member in the guide rail horizontally beside the first sliding bar it is possible to provide a construction that has a small vertical height and, thus, requires little space.

The sliding bar functionally connected to the second door leaf is movably supported to the body member and is arranged to act on the blocking member for opening the clamped-in condition of the first sliding bar at the end phase of the closing of the second door leaf. In practice the head of the second sliding bar is arranged to press the blocking member against the force of the bias spring means for releasing the clamped-in condition. Hereby releasing of the locking provided by the blocking member is carried out simply and reliably.

The first sliding bar may with advantage be provided with transversal grooves, recesses or the like which are arranged in cooperation with the blocking member so that they enhance the force exerted by the blocking member on the sliding bar and at the same time keeping the first door leaf open.

An advantageous arrangement in view of construction, operation and manufacturing technique can be accomplished in case the blocking member is a roller or a corresponding cylinder-shaped member.

BRIEF DESCRIPTION OF THE DRAWINGS

In the following the invention is described by way of example with reference to the attached drawings, in which.

DETAILED DESCRIPTION

Figures 1, 1A:
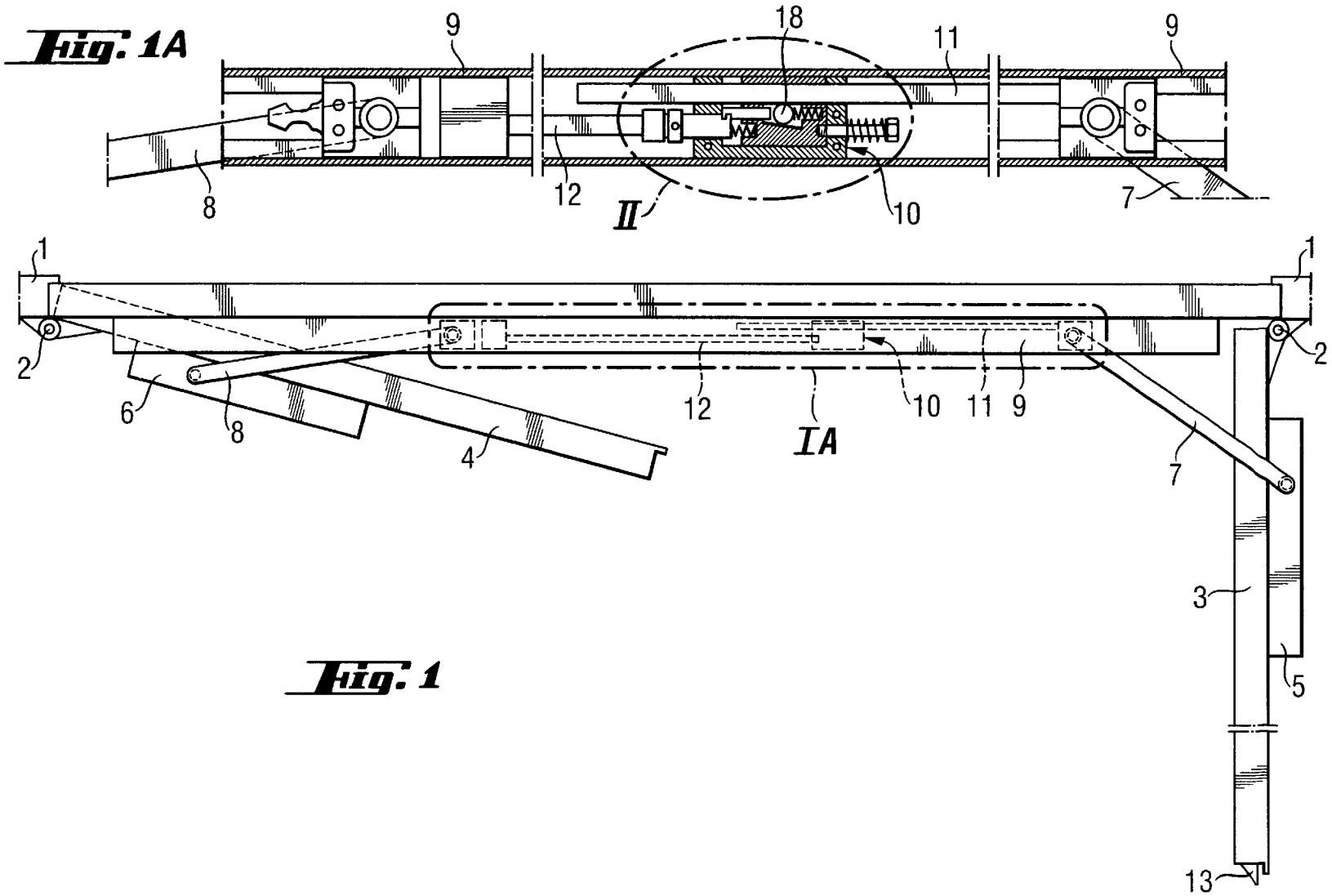
FIG. 1 shows schematically a closure sequence control arrangement embodying the invention for a pair of doors, viewed from above and with the door leaves open.
FIG. 1A shows a partial enlargement of the area IA of FIG. 1.

In the drawings 1 indicates a door frame, to which a pair of doors are supported by means of hinges 2, the doors including an active door 3, which is provided with a latch bolt 13, and an auxiliary door or passive door 4. The active door 3 is provided with a door closer 5 having a turning arm 7, which guides a sliding bar 11 in accordance with the movements of the active door 3. The sliding bar 11 is located in a guide rail 9, which is fixed to the part of the frame located above the door opening (not shown in the figures). During closing movement of the active door 3, the turning arm guides the sliding bar 11 to move monotonically to the left of FIG. 1. Correspondingly the auxiliary door 4 is provided with a door closer 6 having a turning arm 8, which guides a sliding bar 12, which is also located in the guide rail 9 and which controls a closure sequence control unit 10 for the door leaves.

Figure 2:
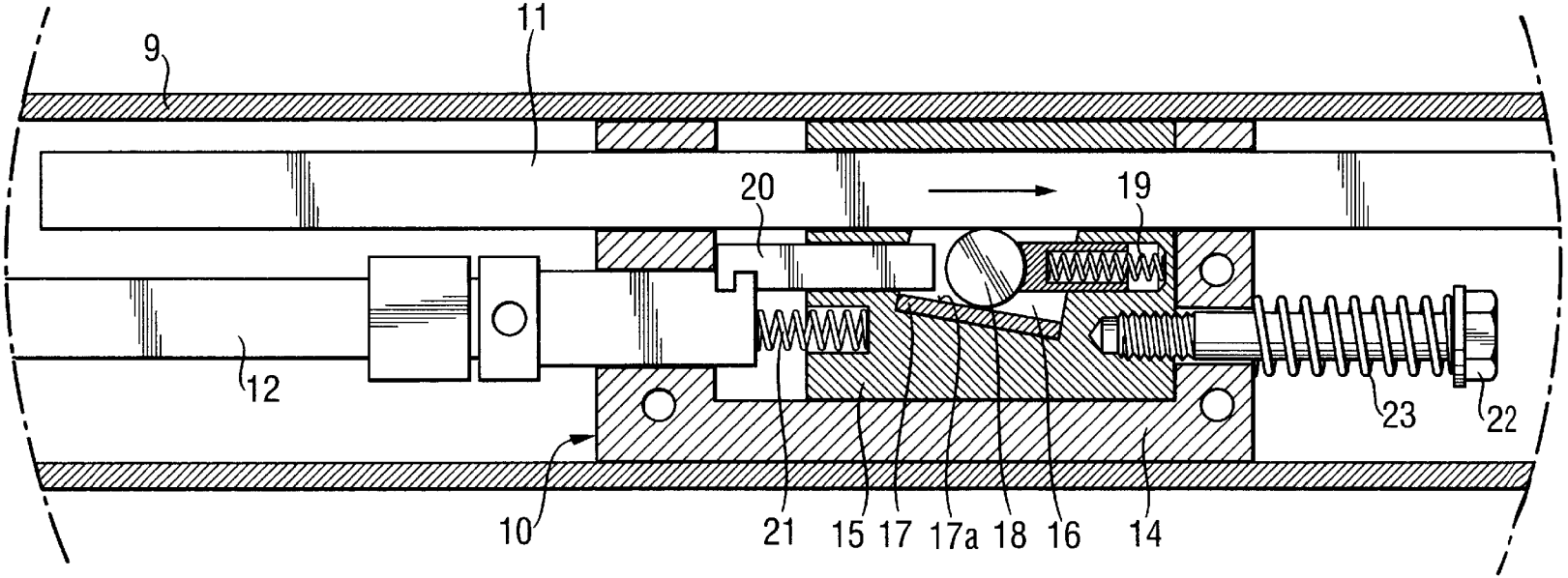
FIG. 2 shows a partial enlargement of the area II of FIG. 1A with the doors in the position of FIG. 1, whereby the sequence control means is in an active state so as to determine the closing order of the door leaves.

As is more clearly apparent from FIG. 2, the sequence control unit 10 includes a body member 14 fixed to the guide rail 9 for instance by means of screws and through which the sliding bar 11 extends. The body member 14 encloses a lock body element 15, in a chamber 16 of which there is a blocking member 18. The chamber 16 is bounded by a guiding surface 17*a* which is inclined towards the sliding bar 11 in the direction of movement of the sliding bar 11 during closing movement of the active door 3. A spring means 19 urges the blocking member 18 in the said direction so that the guiding surface 17*a* guides the blocking member 18 against the sliding bar 11. When the active door 3 begins to close, the blocking member 18 is jammed between the guiding surface 17*a* and the sliding bar 11 and the sliding bar 11 is thereby locked against further movement and prevents closing of the active door.

The guiding surface 17*a* is a surface of a separate guiding member 17 located in the chamber 16.

The blocking member 18 located in the chamber 16 is also influenced by a sliding bar 12 which is dependent on the closing of the auxiliary door 4 and is provided for this purpose with a releasing member 20 coupled to an end of the sliding bar 12 according to the embodiment of the figures. A spring 21 urges the sliding bar 12 into the position of FIG. 2 which corresponds to the activated position of the sequence control arrangement. The auxiliary door 4 is functionally connected to the sliding bar 12 by the turning arm 8 only at the end phase of the closing of the auxiliary door. When the auxiliary door 4 is open, the auxiliary door 4 is not functionally connected to the sliding bar 4 and accordingly the sliding bar 12 remains in the position shown in FIG. 2.

The operation of the illustrated closure sequence control arrangement is as follows. In the situation of FIG. 1 the active door 3 is fully open and the auxiliary door 4 is open to such a degree that the turning arm 8, which depends on movements of the door 4, does not yet affect the sliding bar 12. As is apparent from FIG. 2 the active door 3 can freely be opened, whereby the sliding bar 11 moves in the direction of the arrow. On the other hand, if one tries to close the active door 3 the sliding bar 11 and the spring means 19 urge the blocking member 18 to the left of FIG. 2, whereby the blocking member 18, guided by the guiding surface 17*a*, presses tightly against the sliding bar 11 and locks it against movement and simultaneously prevents turning of the active door 3 in the closing direction. This is possible since the auxiliary door 4 is sufficiently open that the releasing member 20 cannot act on the blocking member 18. In this situation, on the other hand, the arrangement can also with advantage be utilized as a hold-open device for the active door enabling free selection of the hold-open angle for the active door.

Figure 3:
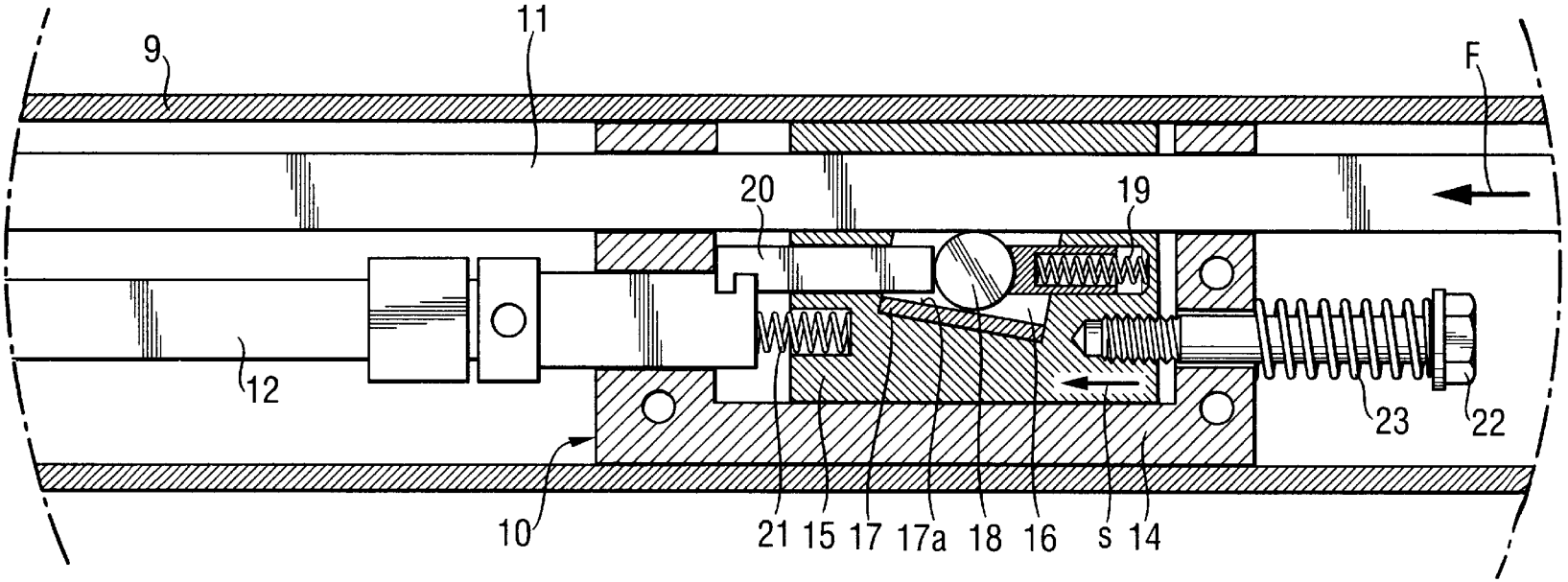
FIG. 3 shows a view similar to FIG. 2 with the active door in a so called overload situation.

The situation of FIG. 3 basically corresponds to the one shown in FIG. 2, but shows the operation of the so-called overload protection. Overload protection is needed in case the force urging the active door in the closing direction of the door is exceptionally large, so that it might otherwise break or damage the sequence control arrangement. For this purpose it will be observed that in the illustrated embodiment of the invention the lock body element 15 is movable relative to the body member 14, an adjustment screw 22 is connected with threads to the lock body element 15, and a compression spring 23 is effective between the head of the adjustment screw 22 and the body member 14. Thus if a large force F affects the active door 3 the sliding bar 11 tends to move to the left in FIG. 3 (arrows) irrespective of the blocking member 18. In order to prevent breaking of the structure the lock body element can then move with regard to the body member 14 in the direction of the sliding bar 11 to the left in the figure against the force of the spring 23 until the blocking member 18 engages the releasing member 20, which is limited against movement to the left of the body member 14 and releases the blocking member 18 from its clamped-in or locking position which locks the sliding bar 11. As a consequence of this the sliding bar 11 and thus also the active door 3 can move independent of the position of the sliding bar 12.

Figure 4A:
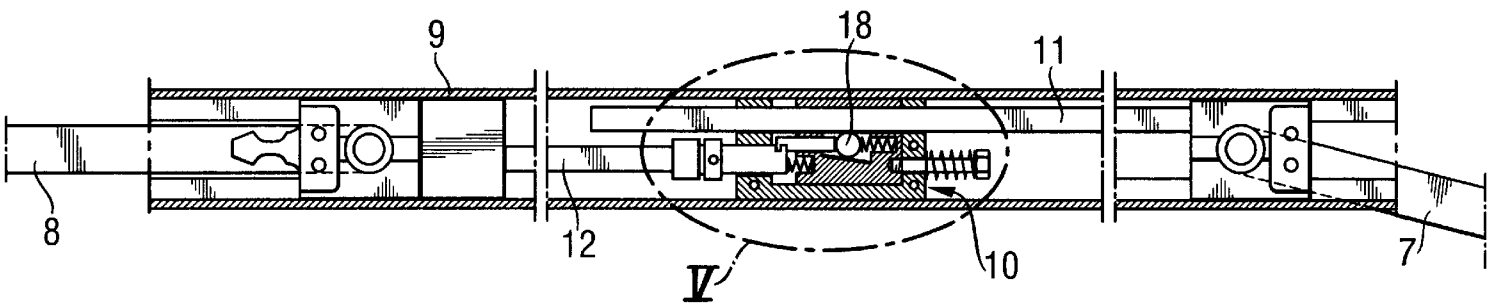
FIG. 4A shows a partial enlargement of the area IVA of FIG. 4.
Figure 4:
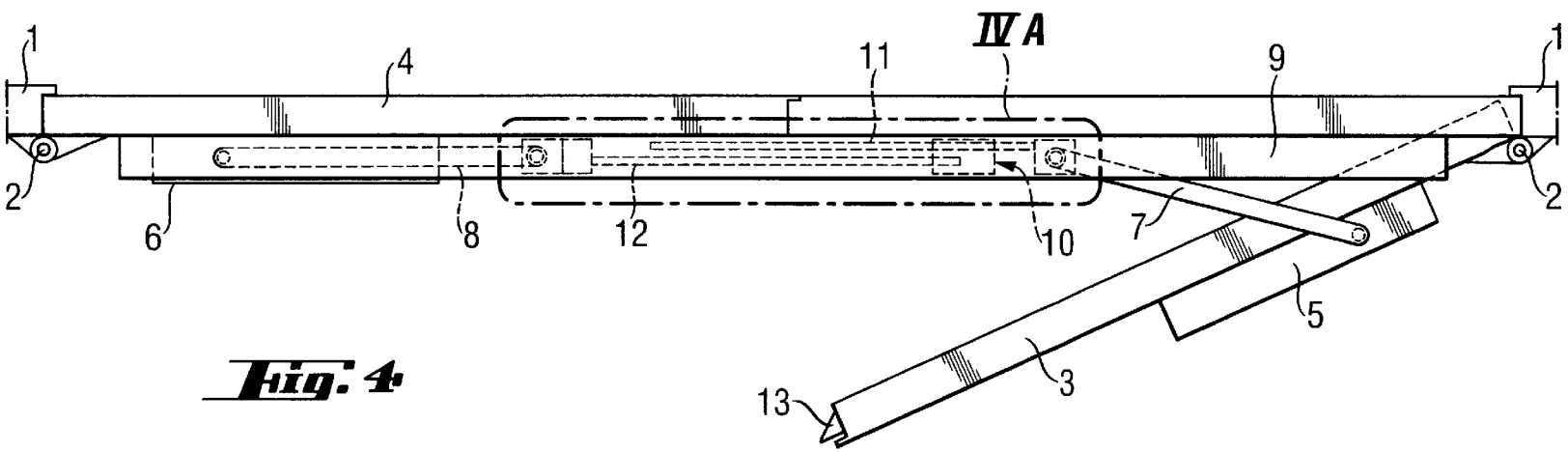
FIG. 4 shows the arrangement of FIG. 1 in a situation in which the auxiliary door is fully closed.
Figure 5:
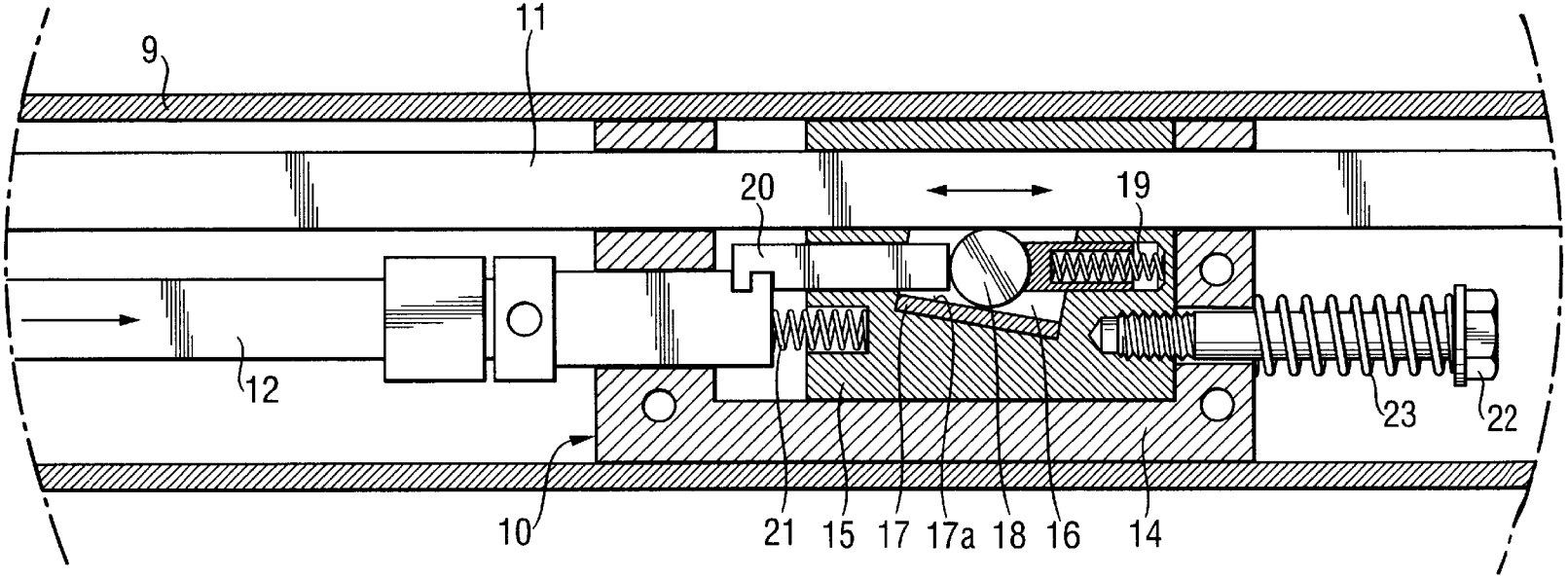
FIG. 5 shows a partial enlargement of the area V of FIG. 4A in a situation in which the closed auxiliary door allows free opening or closing of the active door.

FIGS. 4 and 5 show a situation in which the auxiliary door 4 is closed. Then the turning arm 8 engages the sliding bar 12 and therefore the releasing member 20 continuously urges the blocking member 18 against the force of the spring means 19 into a position in which the blocking member 18 releases the sliding bar 11 and allows free movement of the sliding bar 11 in both directions and hence allows both opening and closing movement of the active door 3. In this condition of the closure sequence control arrangement, the sequence control unit 10 cannot be utilized as a hold-open device for the active door 3 as described above.

Figure 6:
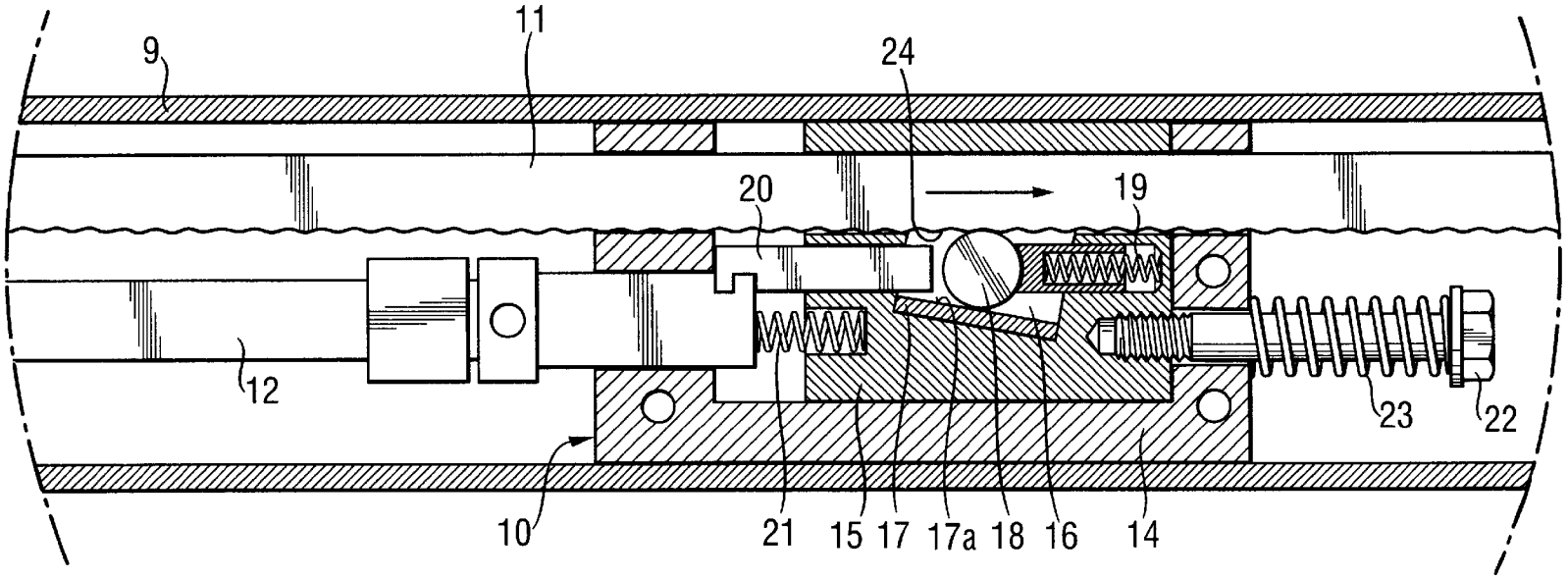
FIG. 6 shows a view similar to FIG. 2 with a certain constructional modification.

FIG. 6 shows a slightly modified arrangement corresponding partially to the situation of FIG. 2. In the case of FIG. 6, the sliding bar 11 includes in the length segment affected by the blocking member 18 a number of transverse grooves, recesses or the like 24. When the sequence control unit 10 is utilized as a hold-open device for the active door 3, the formations 24 increase the force with which the blocking member 18 resists movement of the sliding bar 11 which helps to ensure that the active door 3 remains in its certain selected open position.

The hold-open force may also be influenced by suitable design of the guiding surface 17*a*. From the view point of manufacturing it is simplest that the surface is flat or planar, but when needed the surface may also be for instance arcuate.

The invention is not limited to the embodiments shown but several modifications are feasible within the scope of the attached claims.

What is claimed is:

1. A closure sequence controller for first and second door leaves pivotable with respect to a door frame, the first door leaf being provide with a first door closer and a first turning arm attached to the first door closer for closing the first door leaf, the second door leaf being provided with a second door closer and a second turning arm attached to the second door closer for closing the second door leaf, the closure sequence controller comprising:

an elongate guide rail for mounting to the door frame, a first elongate sliding bar slidably positioned in the guide rail and functionally connected to the first door leaf in a manner such that the first sliding bar moves in response to pivotal movement of the first door leaf relative to the door frame, and a sequence control unit installed in the guide rail and functionally connected to the first sliding bar, the sequence control unit including a lock body structure defining a chamber through which the first sliding bar extends and having a guiding surface that is inclined with respect to the first sliding bar, a blocking member located in the chamber and movable therein against the guiding surface, and a biasing means for urging the blocking member in a direction towards a position in which the blocking member is clamped against the first sliding bar and prevents dosing of the first door leaf.

2. A closure sequence controller according to claim 1, wherein the lock body structure comprises a lock body element and a separate guiding member having said guiding surface.

3. A closure sequence controller according to claim 2, wherein said guiding member comprises hardened steel.

4. A closure sequence controller according to claim 1, wherein the biasing means includes a spring located in said chamber and arranged to urge the blocking member in said direction.

5. A closure sequence controller according to claim 1, wherein the sequence control unit comprises a body member fixed to the guide rail, the lock body structure is movably supported to said body member, and the sequence control unit further comprises a spring that resists movement of the lock body structure relative to the body member in said direction.

6. A closure sequence controller according to claim 5, comprising an adjustment screw which extends through a wall of the body member and is in threaded engagement with the lock body structure and wherein the spring engages the body member and is installed on the adjustment screw.

7. A closure sequence controller according to claim 5, wherein the lock body structure and the body member are located in the guide rail horizontally beside the first sliding bar.

8. A closure sequence controller according to claim 5, comprising a second elongate sliding bar engaging the body member and being movable relative thereto for acting on the blocking member to urge the blocking member in a direction away from said position and thereby releasing the first sliding bar at an end phase of a closing of the second door leaf.

9. A closure sequence controller according to claim 8, wherein the second sliding bar has an end that is arranged to press the blocking member in said direction away from said position for releasing the first sliding bar.

10. A closure sequence controller according to claim 1, wherein the first sliding bar has transverse formations that cooperate with the blocking member to enhance a force exerted by the blocking member on the first sliding bar when the blocking member is clamped against the first sliding bar.

11. A closure sequence controller according to claim 1, wherein the blocking member is a cylinder-shaped member.

12. A closure sequence controller according to claim 1, comprising a second elongate sliding bar engaging the sequence control unit and being movable relative thereto for acting on the blocking member to urge the blocking member in a direction away from said position and thereby releasing the first sliding bar at an end phase of a closing of the second door leaf.

13. A closure sequence controller according to claim 12, wherein the biasing means includes a spring located in said chamber and arranged to urge the blocking member in said direction towards said position, and the second sliding bar has an end that is arranged to press the blocking member against a force of said spring for releasing the first sliding bar.

14. A door installation including:

a door frame, a pair of first and second door leaves pivotable with respect to the door frame, a first door closer and a first turning arm attached thereto for closing the first door leaf, a second door closer and a second turning arm attached thereto for closing the second door leaf, and a closure sequence controller comprising an elongate guide rail mounted to the door frame, a first elongate sliding bar slidably positioned in the guide rail and functionally connected to the first door leaf in a manner such that the first sliding bar moves in response to pivotal movement of the first door leaf relative to the door frame, and a sequence control unit installed in the guide rail and functionally connected to the first sliding bar, the sequence control unit including a lock body element defining a chamber through which the first sliding bar extends, a guiding member having a guiding surface that is inclined with respect to the first sliding bar, a blocking member located in the chamber and movable therein against the guiding surface, and a biasing means for urging the blocking member in a direction towards a position in which the blocking member is clamped against, first sliding bar.

15. A door installation according to claim 14, wherein the sequence control unit comprises a body member fixed to the guide rail, the lock body element is movably supported by said body member, and the sequence control unit further comprises a spring that resists movement of the lock body element relative to the body member in said direction.

16. A door installation according to claim 15, comprising an adjustment screw which extends through a wall of the body member and is in threaded engagement with the lock body element and wherein the spring engages the body member and is installed on the adjustment screw.

17. A door installation according to claim 15, wherein the lock body element and the body member are located in the guide rail horizontally beside the first sliding bar.

18. A door installation according to claim 15, comprising a second elongate sliding bar engaging the body member and being movable relative thereto for acting on the blocking member to urge the blocking member in a direction away from said position and thereby releasing the first sliding bar at an end phase of a closing of the second door leaf.

19. A door installation according to claim 18, wherein the second sliding bar has an end that is arranged to press the blocking member in said direction away from said position for releasing the first sliding bar.

20. A door installation according to claim 15, comprising a second elongate sliding bar engaging the sequence control unit and being movable relative thereto for acting on the blocking member to urge the blocking member in a direction away from said position and thereby releasing the first sliding bar at an end phase of a closing of the second door leaf.

21. A door installation according to claim 20, wherein the biasing means includes a spring located in said chamber and arranged to urge the blocking member in said direction towards said position, and the second sliding bar has an end that is arranged to press the blocking member against a force of said biasing means spring for releasing the first sliding bar.

22. A door installation according to claim 14, wherein the guiding surface of the guiding member is inclined towards the first sliding bar in a direction away from the first turning arm.

* * * * *

UNITED STATES PATENT AND TRADEMARK OFFICE

CERTIFICATE OF CORRECTION

PATENT NO. : 6,742,302 B2
DATED : June 1, 2004
INVENTOR(S) : Vesa Kärkkäinen

It is certified that error appears in the above-identified patent and that said Letters Patent is hereby corrected as shown below:

Column 5,
Line 10, “provide” should be deleted and replaced with -- provided --.

Column 6,
Line 48, the comma should be deleted and replaced with -- the --.

Signed and Sealed this

Twentieth Day of July, 2004

JON W. DUDAS
*Acting Director of the United States Patent and Trademark Office*